US007614203B2

(12) United States Patent
Oltrogge

(10) Patent No.: US 7,614,203 B2
(45) Date of Patent: Nov. 10, 2009

(54) USER INSTALLABLE VACUUM SEAL APPARATUS FOR STORAGE BAGS

(75) Inventor: John P. Oltrogge, Westminister, CO (US)

(73) Assignee: Safety Solutions, Inc., Springs City, UT (US)

( * ) Notice: Subject to any disclaimer, the term of this patent is extended or adjusted under 35 U.S.C. 154(b) by 179 days.

(21) Appl. No.: 10/905,547

(22) Filed: Jan. 10, 2005

(65) Prior Publication Data

US 2005/0172577 A1 Aug. 11, 2005

Related U.S. Application Data

(60) Provisional application No. 60/481,887, filed on Jan. 13, 2004.

(51) Int. Cl.
*B65B 31/00* (2006.01)

(52) U.S. Cl. ..... 53/434; 53/90; 53/139.2

(58) Field of Classification Search ..... 53/432, 53/434, 133.4, 139.2, 90, 133.2, 412, 13, 53/512; 493/87, 213; 206/524.8, 522; 383/66, 383/80, 103, 100

See application file for complete search history.

(56) References Cited

U.S. PATENT DOCUMENTS

| | | | | |
|---|---|---|---|---|
| 71,582 A | | 12/1867 | Cook | |
| 892,254 A | | 6/1908 | Hanson | |
| 1,521,614 A | | 1/1925 | Frimand | |
| 3,799,427 A | * | 3/1974 | Goglio | 383/103 |
| 3,808,981 A | * | 5/1974 | Shaw | 206/522 |
| 3,949,934 A | * | 4/1976 | Goglio | 383/103 |
| 3,980,226 A | | 9/1976 | Franz | |

(Continued)

FOREIGN PATENT DOCUMENTS

| | | |
|---|---|---|
| EP | 0 806 356 A1 | 11/1997 |

(Continued)

OTHER PUBLICATIONS

Millipore, Sterilizing-grade Durapore® 0.22 um Hydrophobic Filter, data sheet, Sep. 2003.

(Continued)

*Primary Examiner*—Louis K Huynh
(74) *Attorney, Agent, or Firm*—David B. Tingey; Kirton & McConkie

(57) ABSTRACT

A valve assembly for use with a self-sealing collapsible storage bag, the valve assembly having a first portion comprising a housing that has a sealing surface and contains a valve mechanism. A second portion has a sealing surface that is configured to mate with the sealing surface of the first portion. A snap mechanism is configured to allow the first and second portions to be snapped together with their respective sealing surfaces facing each other to form a substantially airtight seal. In operation, the first and second portions are positioned on opposing sides of a panel of a plastic storage bag, and snapped together so as to sandwich the panel between the first and second portions of the valve assembly. The plastic bag is pierced in the area of the valve assembly either during installation of the valve assembly, or later by insertion of a nozzle. Gas or fluid such as air may be selectively removed from or added to the interior of the storage bag through the valve mechanism.

19 Claims, 9 Drawing Sheets

U.S. PATENT DOCUMENTS

| | | | | | |
|---|---|---|---|---|---|
| 4,018,253 | A | * | 4/1977 | Kaufman | 141/65 |
| 4,021,290 | A | | 5/1977 | Smith | |
| 4,330,975 | A | | 5/1982 | Kakiuchi | |
| 4,337,804 | A | | 7/1982 | Maruscak | |
| 4,459,139 | A | | 7/1984 | vonReis et al. | |
| 4,484,697 | A | * | 11/1984 | Fry, Jr. | 222/95 |
| 4,561,868 | A | | 12/1985 | vonReis et al. | |
| 4,576,210 | A | | 3/1986 | Lepisto | |
| 4,982,481 | A | | 1/1991 | Deutscher | |
| RE33,969 | E | * | 6/1992 | Richter | 222/1 |
| 5,195,427 | A | | 3/1993 | Germano | |
| 5,240,112 | A | | 8/1993 | Newburger | |
| 5,333,736 | A | * | 8/1994 | Kawamura | 206/524.8 |
| 5,450,963 | A | * | 9/1995 | Carson | 206/524.8 |
| 5,480,030 | A | | 1/1996 | Sweeney et al. | |
| 5,544,752 | A | | 8/1996 | Cox | |
| 5,701,910 | A | | 12/1997 | Powles et al. | |
| 5,765,608 | A | | 6/1998 | Kristen | |
| 5,839,582 | A | | 11/1998 | Strong et al. | |
| 5,873,967 | A | | 2/1999 | Clark et al. | |
| 5,931,189 | A | * | 8/1999 | Sweeney et al. | 137/512.15 |
| 5,954,196 | A | * | 9/1999 | Lin | 206/286 |
| 5,989,613 | A | | 11/1999 | Buchko | |
| 6,039,182 | A | | 3/2000 | Light | |
| 6,045,264 | A | | 4/2000 | Miniea | |
| 6,059,457 | A | | 5/2000 | Sprehe et al. | |
| 6,070,397 | A | | 6/2000 | Bachhuber | |
| 6,070,728 | A | * | 6/2000 | Overby et al. | 206/524.8 |
| 6,227,706 | B1 | | 5/2001 | Tran | |
| 6,261,276 | B1 | | 7/2001 | Reitsma | |
| 6,328,718 | B1 | | 12/2001 | Chiang et al. | |
| 6,334,760 | B1 | | 1/2002 | Walker | |
| 6,440,100 | B1 | | 8/2002 | Prentiss | |
| 6,581,641 | B2 | | 6/2003 | Skeens et al. | |
| 6,604,634 | B2 | | 8/2003 | Su | |
| 6,623,631 | B1 | | 9/2003 | Graus et al. | |
| 6,675,654 | B2 | | 1/2004 | Hegner et al. | |
| 6,685,665 | B2 | | 2/2004 | Booth et al. | |
| 6,694,710 | B2 | | 2/2004 | Wang | |
| 6,712,334 | B2 | * | 3/2004 | Motonaka et al. | 251/149.6 |
| 6,837,268 | B2 | * | 1/2005 | Skeens et al. | 137/550 |
| 6,896,713 | B1 | | 5/2005 | Eckerbom et al. | |
| 2003/0000180 | A1 | | 1/2003 | Singer | |
| 2004/0173626 | A1 | | 9/2004 | Jeor | |

FOREIGN PATENT DOCUMENTS

| | | |
|---|---|---|
| WO | WO 93/01882 | 2/1993 |
| WO | WO 95/16619 | 6/1995 |
| WO | WO 95/22497 | 8/1995 |
| WO | WO 00/22979 | 4/2000 |
| WO | WO 03/082430 A1 | 10/2003 |

OTHER PUBLICATIONS

GE Osmonics Labstore, GE Polypropylene Syringe Filters, product Information, Oct. 12, 2005.

Disposable Hydrophobic Filter, http://www.phippsbird.com/pumps.html.

* cited by examiner

USER INSTALLABLE VACUUM SEAL APPARATUS FOR STORAGE BAGS

RELATED APPLICATIONS

The present invention claims the benefit of U.S. Provisional Application Ser. No. 60/481,887 filed on Jan. 13, 2004, the specification of which is incorporated herein by reference.

FIELD OF THE INVENTION

The present invention relates, in general, to disposable, flexible, self-sealing storage bags and, more particularly, to an valve feature for disposable, self-sealing storage bags that can be installed and removed by an end user that facilitates the convenient evacuation of air and/or pressurization of the storage bag as well as maintaining an airtight seal to prevent gasses from leaving or entering the storage bag.

RELEVANT BACKGROUND

Self-sealing, disposable, plastic storage bags are flexible, disposable plastic bags commonly used to temporarily store food, such as leftovers or sandwiches, or to place food, such as meats, in the freezer over a long period of time. These storage bags incorporate interlocking strips which extend across an open end of the bag. The interlocking strips include mateable male and female, or tongue and groove portions which interlock to close the open end of the bag. Examples include storage bags sold under the trademark ZIPLOC®, which is a registered trademark of SC Johnson & Son, Inc. and GLAD®, which is a registered trademark of the Glad Products Company. Self-sealing storage bags are primarily purchased in the consumer market for storing perishable foods.

Once contents are placed in the storage bag, the male and female strips are oriented, engaged, and pressed shut by applying pressure across the strips with the fingers or a slide mechanism. Conventional self-sealing bags, however, are not designed for conveniently evacuating air from the bag or for maintaining an airtight seal. Hence, food can still go stale or suffer freezer burn as a result of trapped air within the bag. This is because conventional self-sealing storage bags do not offer structure for evacuating air.

To evacuate air from inside the bag, users try to keep a segment of the bag open while pressing down on the bag to force air out. This process fails to remove all the air and is a crude, inconvenient way to evacuate air. Other users may attempt to use their mouth to suck air from the storage bag. This process also unable to remove all air, and risks contamination of the bag's contents with germs.

A significant problem associated with providing an airtight, self-sealing bag that evacuates air relates to manufacturing. Plastic storage bags are extruded and formed at a high speed which reduces production costs so that the storage bags can be marketed at a price point that is acceptable to consumers. High speed manufacturing processes make it difficult to alter the structure of the bag without affecting production and therefore increasing cost significantly. Existing processes and techniques for installing valve assemblies, for example, increase the cost of a storage bag to the point that it is no longer practical for disposable applications in which storage bags are commonly employed.

U.S. Pat. No. 5,240,112, issued to Neuberger, shows a storage bag with a stem with a pinched valve protruding outward from the lower end. U.S. Pat. No. 5,544,752, issued to Cox, shows storage bag that includes a permanent, exterior suction conduit that is designed to break off after use. U.S. Pat. No. 3,980,226, issued to Franz, comprises a storage bag having a permanently affixed evacuating tube with a threaded cap and an open end which is tied shut. U.S. Pat. No. 6,045,264 shows a system that attempts to improve on several of the deficiencies of earlier systems, but still requires that the bag itself be formed as a special-purpose evacuable bag. These systems are not compatible with existing extrusion manufacturing techniques.

Some of the more effective food storage systems use a "rolled bag" technique in which the user purchases a roll of material that is essentially a plastic channel, then forms bags by heat sealing two ends of the channel. These systems are often referred to as "seal-a-meal" systems as exemplified in U.S. Pat. No. 4,021,290. Variations of this system have been introduced that provide various mechanisms for removing air from the bag before sealing. These systems tend to be more expensive than disposable storage bags, and they are more difficult to use because the user is actually forming each bag one at a time.

A need exists for a food storage system that is both cost effective and allows users to evacuate air from commercially available self-sealing plastic storage bags.

SUMMARY OF THE INVENTION

The present invention solves the need by providing a valve assembly that can be installed by a user as needed to convert a conventional self-sealing storage bag into a storage bag that can be vacuum sealed. In a specific embodiment, a two-piece snap fit valve assembly is provided that a user can install on any plastic storage bag. Once installed, the valve assembly may be coupled to a vacuum source so that air can be conveniently removed from the storage bag as required by the user. Alternatively, the valve may be used to pressurize the storage bag so as to cushion and protect the contents.

By providing a user-installable valve assembly the storage bag itself can be manufactured using efficient, low-cost processing techniques available to any storage bag manufacturer, while at the same time giving the user the benefit of being able to convert conventional storage bags into vacuum seal storage bags as needed.

DETAILED DESCRIPTION OF THE PREFERRED EMBODIMENTS

The present invention involves improved plastic bag-based storage systems in which a conventional self-sealing storage bag is converted on-demand into an evacuable storage bag. A user-installable valve assembly, conveniently provided as a two-piece, snap together assembly, is installed on any conventional self-sealing plastic storage bag. The user can select the size, brand, quality, and other characteristics from the wide variety of available plastic storage bag options. The present invention also involves a system which includes the valve assembly, self-sealing storage bags and a vacuum source which can be readily attached to evacuate air from storage bags once the valve is installed. While the present invention has significant applicability in food storage, and in particular home food storage, the invention may be used to store other materials to protect them from exposure to air. For example, the present invention is readily employed to store biomedical products and waste, collectibles, valuable papers, digital media, and the like.

Figure 1:
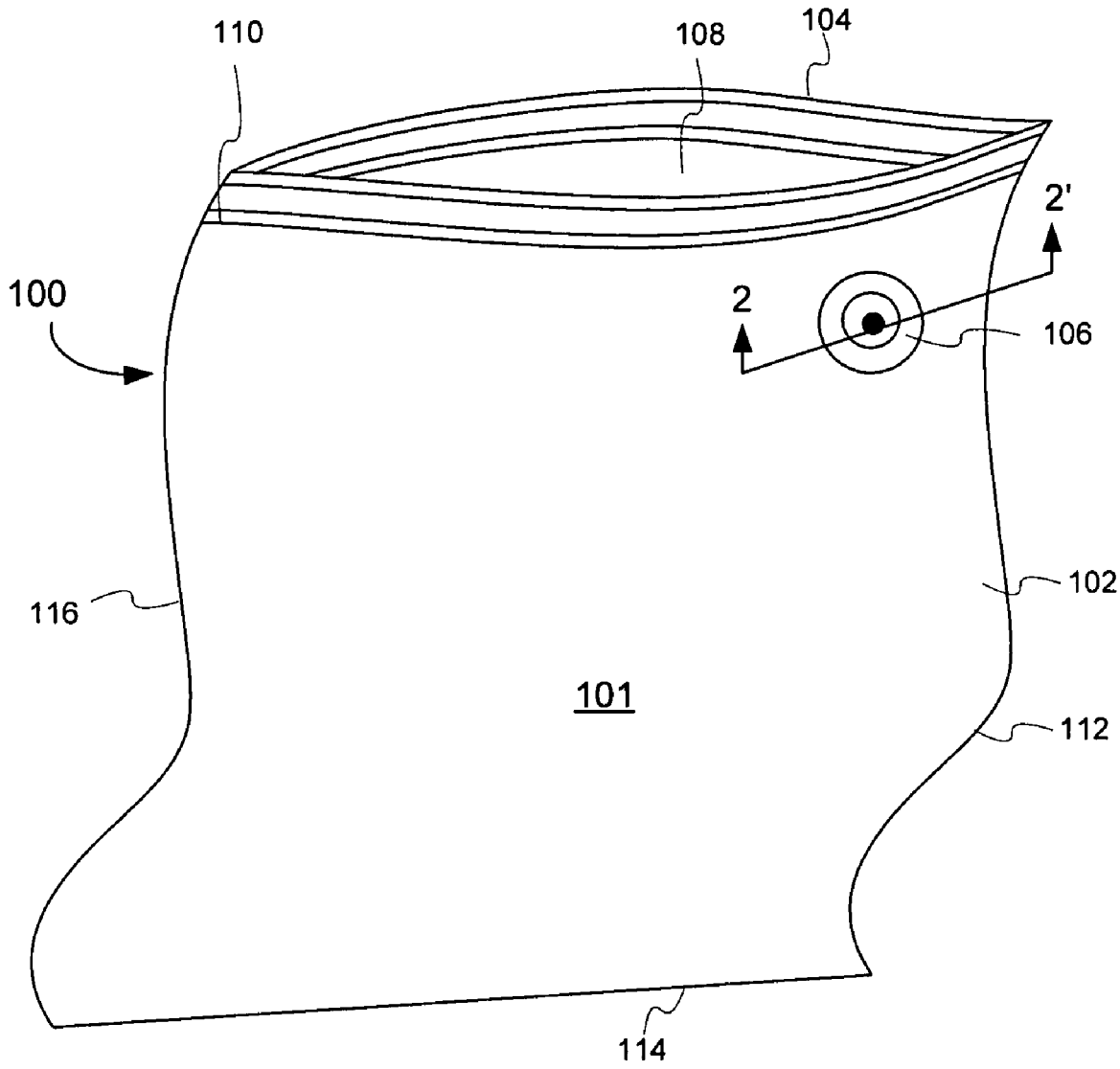
FIG. 1 shows a front view of bag having valve assembly in accordance with invention.

FIG. 1 illustrates a front view of a storage system including a sealable storage bag 100. Bag 100 includes front sheet 102 and rear sheet 104 (partially hidden behind the front sheet) that are sealed at edges 112, 114 and 116 to define a pouch 101. Edges 112, 114 and 116 may be sealed by any convenient means such as heat sealing, ultrasonic welding, or the like, which results in a substantially air tight seal as is common in commercially available storage bags. An open end 108 allows items to be placed within pouch 101. Sealing mechanisms 110 provide a substantially air tight seal when closed. Typical storage bags use a tongue strip on one sheet (e.g., sheet 102) and a complementary groove strip on the opposite sheet (e.g., sheet 104). Although tongue-in-groove sealing mechanisms are common, the present invention is operable with any sealing mechanism 110 including adhesive, clips, heat seal, and the like.

Valve assembly 106 described below is mounted in either the front sheet 102 or back sheet 104 so that a substantially airtight seal is achieved between assembly 106 and sheet 102. By "substantially airtight" it is meant that the seal will inhibit airflow into or out of pouch 101 for a time desired by the user in a particular application. A reasonable amount of time might be a few hours in some applications, up to months or years in other applications.

Bag 100 includes opening 108 between sheet 102 and 104. Reusable/re-closable or zipper type airtight seal 110 is positioned so that it may be opened to receive product e.g., food or other material. The air valve assembly 106 can be installed and seal 110 is closed to form an airtight seal to the bag 100. The bag 100 with reusable seal 110 may be any of several brands including "Ziploc", "Glad", "Hefty", or others. Moreover, many different varieties of bags are available in which the plastic thickness, closure mechanism, plastic type, or other characteristics are modified to enhance performance in particular applications. For example, the present invention is applicable to freezer bags, standard bags, multilayer bags designed to improve freshness, and the like.

Pouch 101 defines an inner volume for placing items such as food, valuables, waste materials, and the like. The present invention enables air or other fluid to be removed from or added to the inner volume after the seal 110 is closed. In this way, air that causes food spoilage can be removed from pouch 101 after it is sealed and/or protective gasses/fluids can be added to pouch 101 after it is sealed.

Figure 2:
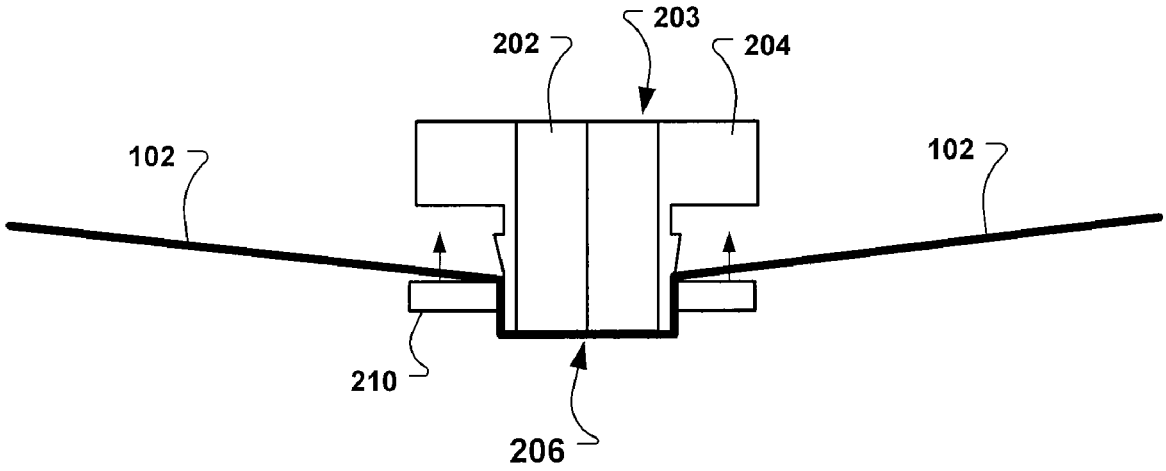
FIG. 2 shows a cutaway view taken along cut line shown in FIG. 1.

FIG. 2 is a cutaway view of the valve assembly along the cut line 2-2' shown in FIG. 1. Valve assembly 106 includes an outer portion 204 and snap ring 210. Outer portion 204 and snap ring 210 are two separate components made of, for example, a food grade plastic material. Valve assembly 106 is assembled by placing snap ring 210 inside of bag 100 and putting outer portion 204 on the outside surface of sheet 102 (or sheet 104) then pressing the outer portion 204 into the snap ring 210 to form an airtight connection.

Outer portion 204 includes a valve mechanism 202 which airflow into or out of bag 100. Valve mechanism 202 may be a one-way or check valve, or a two-way valve. Valve mechanism may be self-sealing or manually operated. In a particular embodiment, valve element 202 comprises an air valve similar to that used for inflating a sports ball. For example, pressurized elastomer can be placed within a cavity defined by cup 203. A tiny hole 206 may be formed through the elastomer to allow a needle to be removeably placed through the valve element 202 when it is desired to and/remove air or fluid from bag 100.

Figure 3:
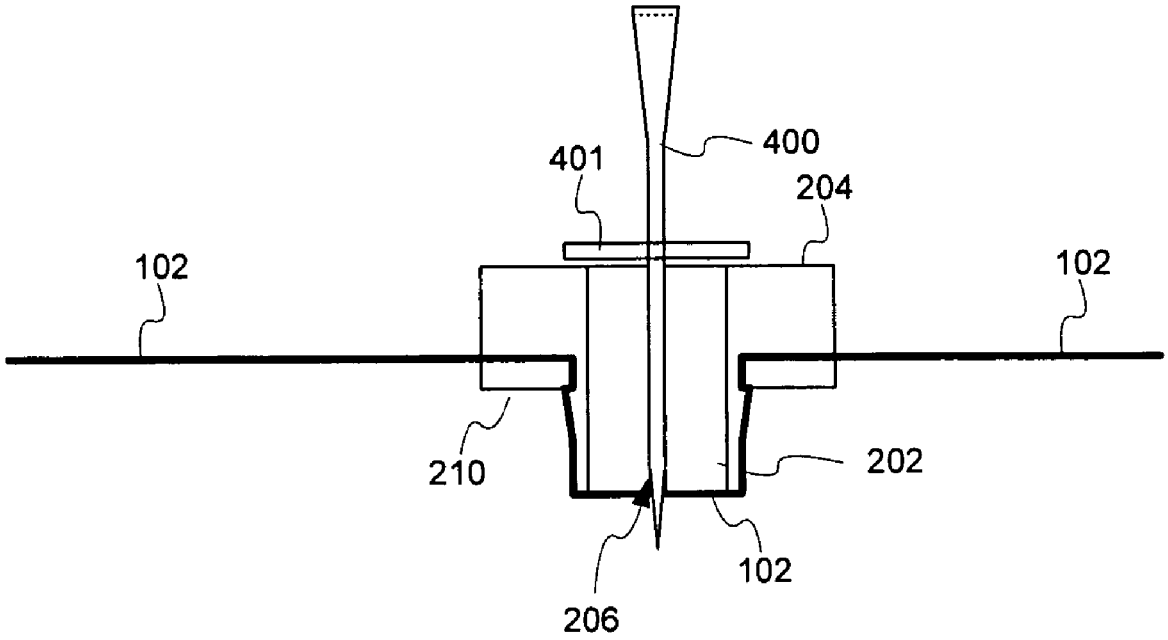
FIG. 3 shows a cutaway view showing air evacuation using a sports ball type valve for the internal of the air valve.

As shown in FIG. 2, as snap ring 210 is installed, the plastic sheet 102 conforms to the contours of outer portion 204 and stretches tight across the bottom of valve mechanism 202. This enables the bag 102 to be pierced cleanly as shown in FIG. 3. In a particular embodiment, outer portion 204 is fitted with a snap protrusion 205 that is spaced downward from the bottom surface of outer portion 205 sufficiently to allow snap ring 210 to seat firmly against outer portion 204 when installed, as shown in FIG. 3.

When installed, as shown in FIG. 3, sheet 102 is sandwiched between snap ring 210 and outer portion 204 with sufficient force to provide the desired airtight seal. Sheet 102 is deformed to conform about the contours of outer portion 204. Needle 400 is pressed through opening 206 to pierce sheet 102 and create a temporary opening that enables air or other fluids to be removed from or added to the interior volume of bag 100. Optionally, a needle stop 401 may be used to limit the penetration of needle 400 into the inner volume of bag 101. Once removed, valve mechanism 202 prevents further air flow. For example, if a pressurized elastomer is used to implement valve mechanism 202, the elastomer closes up opening 206 to create a substantially airtight seal.

Figure 4:
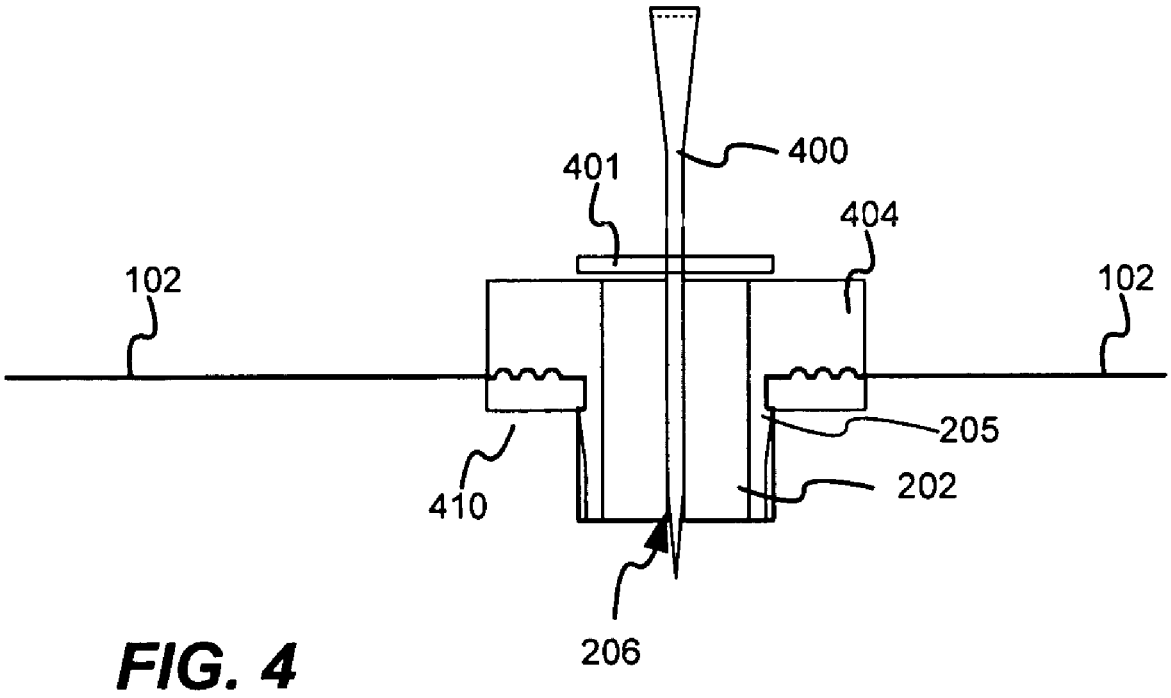
FIG. 4 illustrates a cross-section of an alternative valve and snap ring in accordance with the present invention.

FIG. 4 illustrates an alternative embodiment in which sealing surfaces of upper portion 404 and inner ring 410 are textured to improve sealing. In the particular example, a number of corrugations are placed on the surface to provide a superior seal. The corrugations may be quite small or relatively large as illustrated in FIG. 4. There may be as few as one corrugation up to tens or more if the corrugations are smaller. O-rings or similar sealing mechanisms may be used to improve the seal as well. Also, the sealing surfaces that contact sheet 102 may be coated with an adhesive, gel-type or putty-type sealing enhancer, vacuum oil, or the like (not visible) when desired to improve sealing performance.

Figure 5:
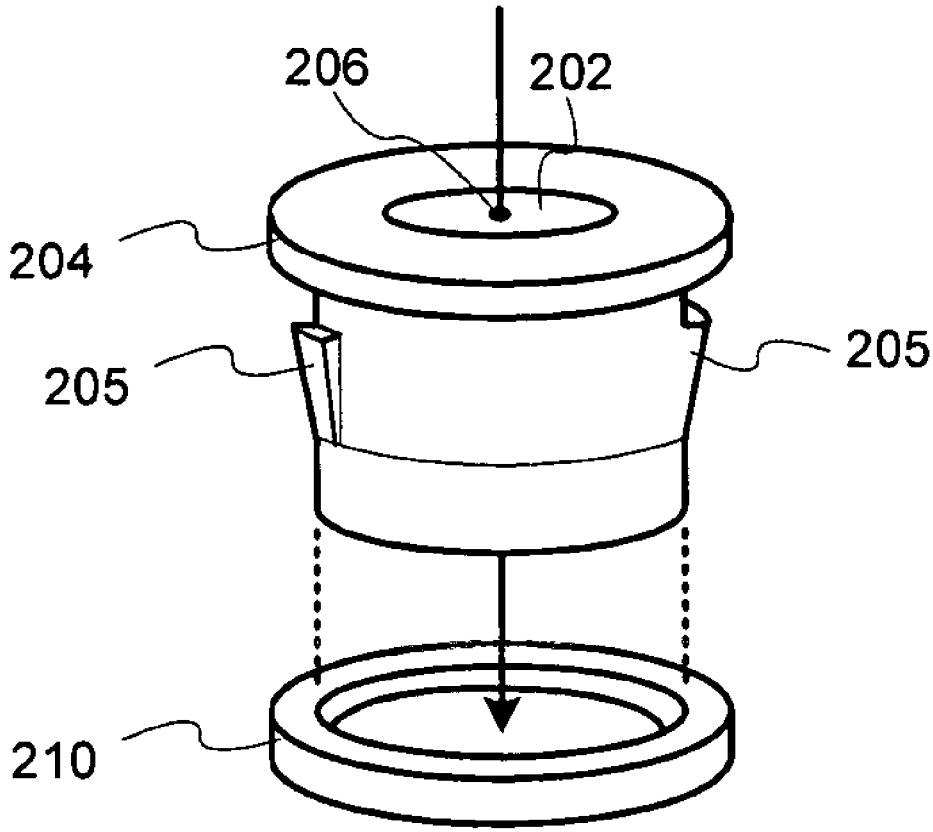
FIG. 5 shows a perspective view of the valve assembly of FIG. 2 to illustrate the snap together features of a particular embodiment of the present invention.

FIG. 5 shows a perspective view of the valve assembly of FIG. 2 to illustrate the snap together features of a particular embodiment of the present invention. Snap protrusions 205 are placed at two or more locations around the circumference of outer portion 204. Snap protrusion 205 may be substantially continuous as well, although this could make installation somewhat more difficult as it would require more pressure to force the snap ring 210 over the snap protrusion 205. In some embodiments, snap protrusion 205 may have a hinge-like attachment to outer portion 204 in that it is attached at only one edge (e.g., its lower edge). This arrangement allows the snap protrusion 205 to move inward to allow snap ring 210 to be forced over, then snap back outward once snap ring 210 has cleared the upper portion of snap protrusion 205. A wide variety of snap type frictional attachment means are known and may be substituted for the particular implementation shown herein.

Figure 6:
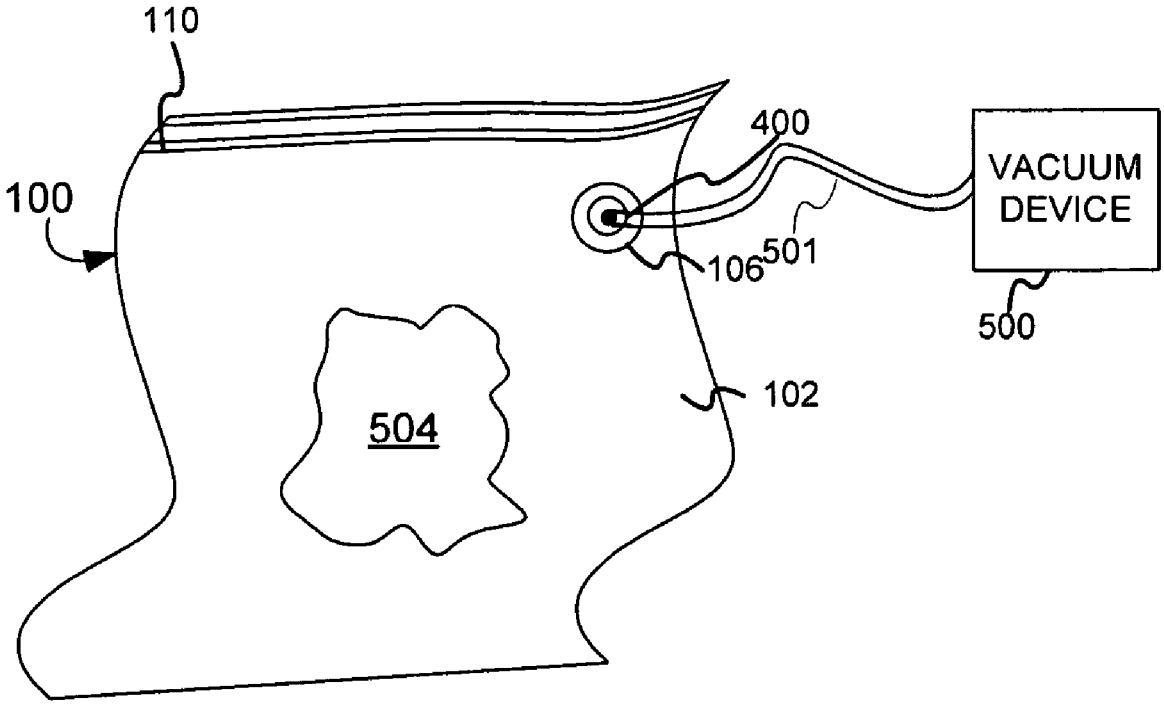
FIG. 6 storage system in accordance with the present invention including a bag with a valve assembly attached to a vacuum source.

FIG. 6 is a schematic view illustrating the storage system in accordance with the present invention including a storage bag and user-installable valve mechanism in accordance with the present invention. In operation, a vacuum source 500 is coupled to nozzle 400 by tubing 501, which is in turn coupled to the inner volume of bag 100 via the valve mechanism in accordance with the present invention. Vacuum source 500 is sized and powered to be capable of drawing the desired vacuum, which need not be particularly strong. Vacuum source 500 may be implemented by a hand operated pump, or an electric pump that is either batter powered or coupled to main power in the kitchen or work area (e.g. Fresh Savers Plus hand-held vacuum pump or some other compact vacuum pump).

FIG. 5 shows the item 504, such as a food product or other material, is placed in the bag 100 and the re-sealable/re-closable seal has been closed. The vacuum then withdraws air by creating a vacuum inside the bag 100. Food is left free of moisture and air preserving the food or product in bag 100. Alternatively, vacuum device 500 may be replaced by a pressurized gas or fluid source. For example, is it increasingly common to purchase canisters of helium, argon, nitrogen or other neutral gas to preserve wine and prevent oxygen exposure to open bottles of wine. These same canisters could be used to pressurize the inner volume of bag 100 with a neutral atmosphere.

Figure 7:
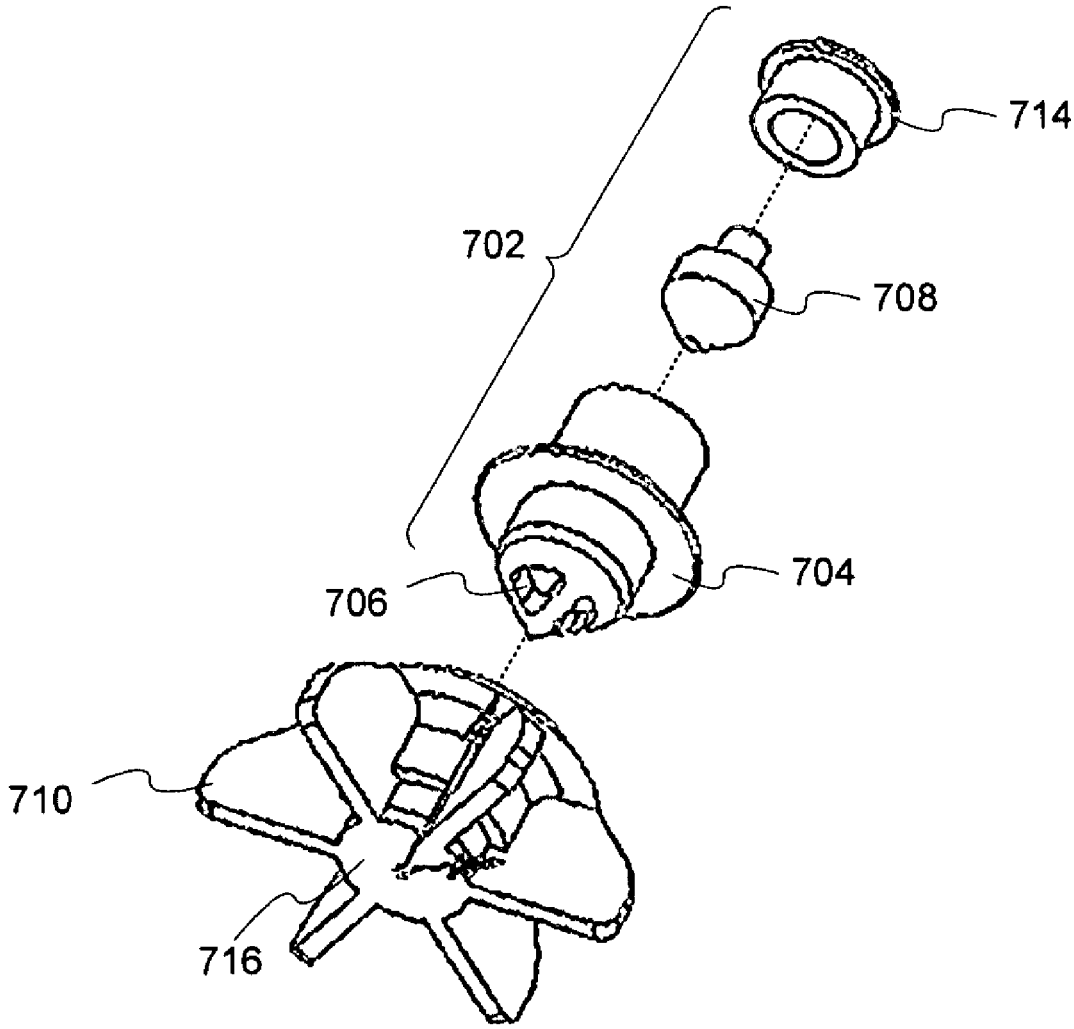
FIG. 7 and FIG. 8 show an exploded view of an alternative embodiment valve assembly in accordance with the present invention.

FIG. 7 shows an exploded view of an alternative embodiment valve assembly in accordance with the present invention. The implementation of FIG. 7 provides a needle-less vacuum coupling which has some advantages when storing materials such as food, hazardous waste, medical materials and the like. In FIG. 7 an outer portion 702 of the assembly is formed as multiple components that are assembled together by welding, gluing or other suitable assembly method that allows closure mechanism 708 to move along the axis illustrated by a dashed line within a cavity formed by a cap 704 and a keeper 714. In a particular embodiment a spring (not visible) is placed inside keeper 714 so as to engage a closure mechanism 708 and push it into sealable contact with surfaces of cap 704. The closure mechanism 708 may comprise, for example, a plunger, ball valve, duckbill valve, umbrella valve, or other available mechanism the meets the needs of a particular application. In an embodiment of the invention a duckbill valve may be used within the cavity formed by cap 704 and keeper 714 to provide a vacuum/pressure seal.

The valve assembly shown in FIG. 7 is assembled into an outer piece 702 and an inner piece or base 710. Base 710 is placed inside a collapsible bag (not shown in FIG. 7) and outer piece 702 is pressed into base 710 from the outside of the bag. Cap 704 is provided with a piercing point having air passages 706 formed therein so as to pierce a hole in the bag sidewall during installation. The tight fitment (e.g., frictional fit, snap fit, or the like) between outer piece 702 and base 710 creates a substantially air-tight seal where the valve assembly is installed.

Figure 9:
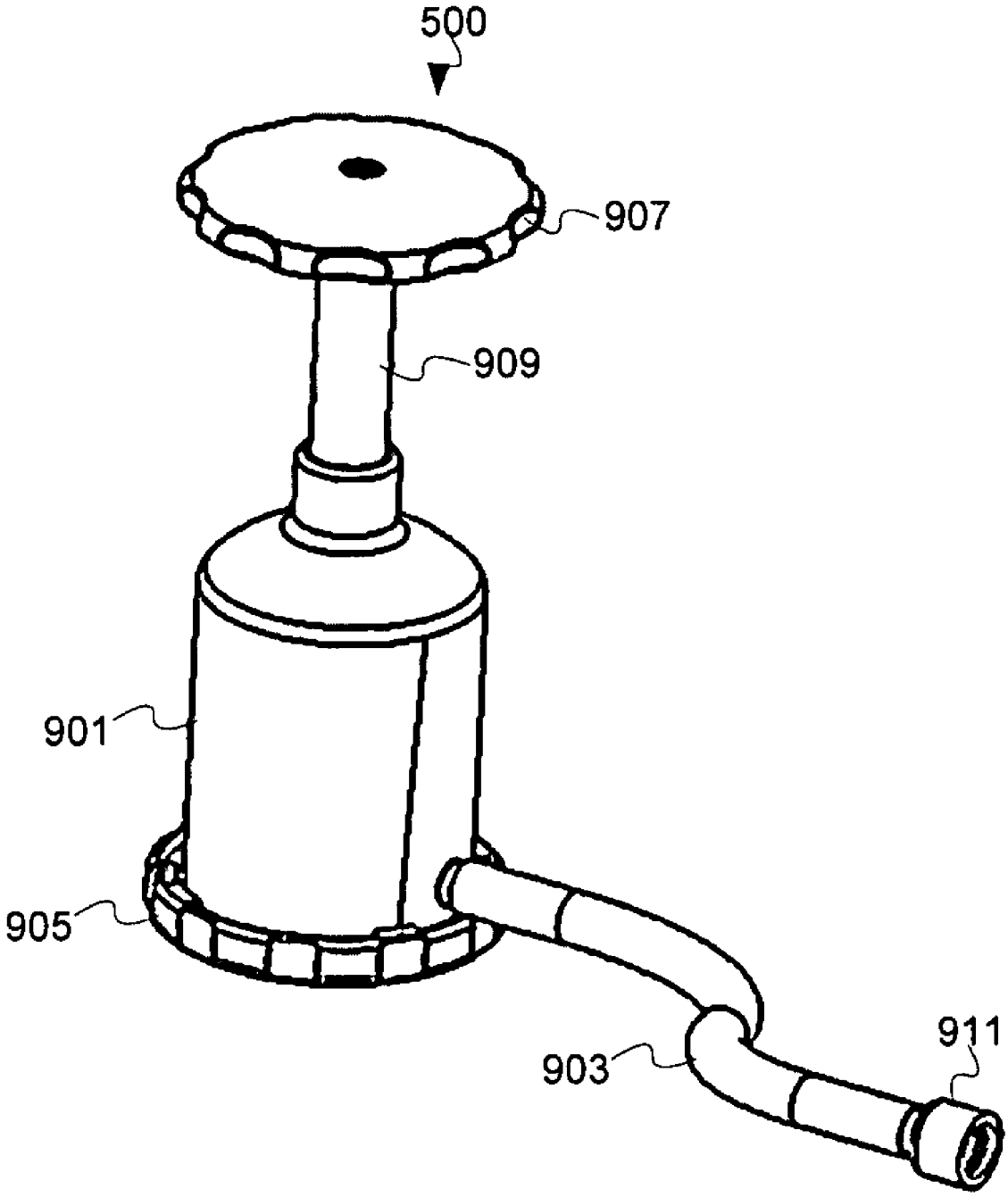
FIG. 9 shows a vacuum source in accordance with an embodiment of the present invention.

In operation, a vacuum source 500, such as shown in FIG. 9, is coupled to keeper 714. Vacuum source 500 creates a negative pressure that will urge the closure mechanism 708 away from sealing surfaces of component 714 and compress the spring within keeper 714. The action of closure mechanism 708 opens a passageway for gasses to flow through from pass through passages 716 and 706 and out of the bag through the now-open valve assembly. When the vacuum source is release the spring automatically closes the valve by forcing closure mechanism 708 into sealable contact with cap 704. Base 710 may be formed with a number of fins that inhibit the bag sidewalls from collapsing and blocking air passage 716/706.

Figure 8:
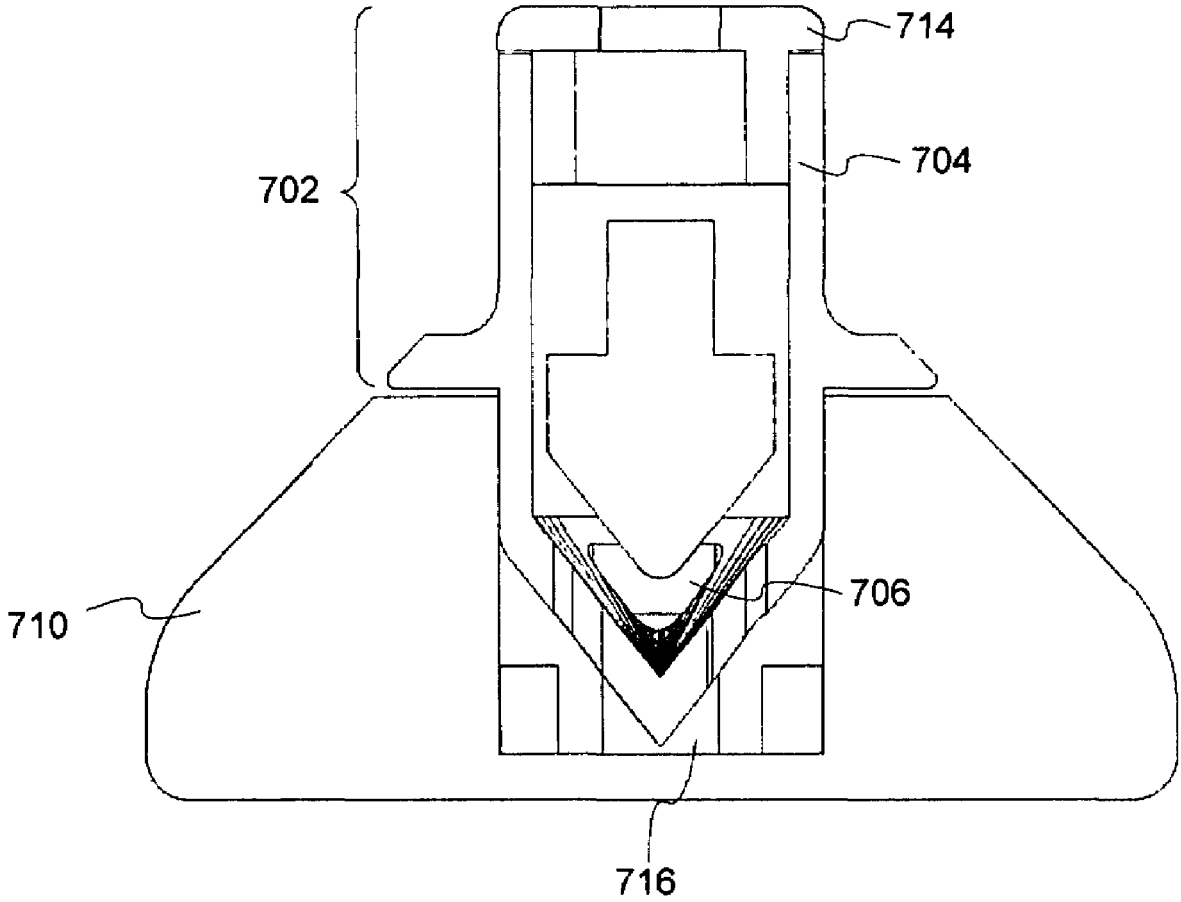

FIG. 8 shows the valve assembly of FIG. 7 in an assembled state. In FIG. 8 a bag is not shown to ease illustration and understanding. In practice, a bag sidewall would be located where the lowest portion of out piece 702 meets with the uppermost portion of base 710. Once assembled as shown in FIG. 8 the present invention provides a compact, user installable system for removing air from a collapsible storage bag.

FIG. 9 shows a hand-operable vacuum source 500 in accordance with an embodiment of the present invention. The particular example in FIG. 9 is similar to a bicycle pump having a pump body 901 that, together with pump end cap 905, defines a cylindrical compression chamber. A piston (not visible) inside chamber 901 is coupled to handle 907 by a piston rod 909. Vacuum source 500 is operated by pumping handle 907 up and down in a manner akin to a bicycle pump. A negative pressure is created and coupled by tubing 903 to a coupling boot 911. Coupling boot 911 is sized to mate with the upper portion of valve assembly 702 during operation.

A useful feature of the vacuum source 500 shown in FIG. 9 is the use of a detachable end cap 905 that allows the compression chamber to be opened for cleaning. In applications that involve storage of liquid or semi-liquid materials inside a storage bag such as food storage, storage of medical materials and the like, there is a possibility that some of the stored material will be pulled through the valve assembly during evacuation. By removing end cap 905 a user can easily clean the inside of the compression chamber and the piston mechanisms therein, as well as have access to tubing 903 so that it can be thoroughly cleaned.

The present invention is applicable in any industry in which storage of a product such that the product is isolated from surrounding gasses is involved. Exemplary use cases include food storage, containment of biomedical materials, containment of hazardous waste, preservation of biological samples, preservation of collectibles and valuables to prevent tarnish, storage of optical devices such as lenses, telescopes, microscopes, binoculars and the like.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

What is claimed is:

1. A method for using a two part valve assembly to modify a storage bag, comprising:

providing a conventional storage bag;

opening the conventional storage bag;

placing a first portion of the two part valve having a first sealing surface inside the storage bag with the first sealing surface facing the storage bag;

placing a second portion of the two part valve assembly having a second sealing surface outside the storage bag with the second sealing surface facing the storage bag; and snapping the first portion and the second portion together to sandwich one panel of the storage bag between the first portion and the second portion, deform the one panel about contours of the first portion, and form a substantially airtight seal between the one panel and each of the first sealing surface and the second sealing surface;

placing an item in the storage bag through an opening;

sealing the opening of the storage bag; and altering the atmosphere within the bag after the snapping and the sealing by adding or removing gas and/or fluid through the two part valve assembly, wherein the act of snapping comprises squeezing the first portion and the second portion together so that the panel is pierced as the first portion and the second portion are fitted together.

2. The method of claim 1 wherein the altering comprises inserting a needle through the two part valve assembly.

3. The method of claim 1 wherein the valve assembly comprises a check valve.

4. The method of claim 1 wherein the valve assembly is formed from a food grade plastic.

5. The method of claim 1, wherein the snapping comprises stretching the one panel tight across a bottom of the first portion.

6. A method of modifying a self sealing storage bag by an end-user attaching a valve assembly, the method comprising:

grasping the storage bag by the end-user;

opening the storage bag by the end-user;

attaching a valve assembly to one panel of the storage bag by the end user to convert the storage bag into an evacuable storage bag at a user location, wherein the valve assembly comprises a first portion and a second portion and the act of attaching the valve assembly comprises squeezing the inner portion and outer portion together so that the panel is pierced as the inner portion and outer portion are fitted together wherein the valve assembly comprises:

the first portion comprising a housing having a first sealing surface, a snap protrusion, and containing a valve mechanism, wherein the sealing surface of the first portion is positioned to contact a first side of the one panel of the storage bag;

the second portion comprising a second sealing surface and an inner ring sized to pass over and interlock with the snap protrusion, wherein the sealing surface of the second portion is positioned to contact a second side of the one panel of the storage bag at a location opposite the first portion of the valve assembly, and the snap protrusion being positioned relative to the first sealing surface to hold each of the first sealing surface and the second sealing surface against a portion of the sheet of the storage bag sandwiched therebetween and deformed about contours of the first portion with sufficient force to form a substantially airtight seal between the sheet of the storage bag and each of the first sealing surface and the second sealing surface while leaving the valve mechanism accessible to a user;

placing an item in the storage bag through an opening;

sealing the opening of the storage bag; and altering the atmosphere within the bag after sealing by adding or removing gas and/or fluid through the valve assembly after the attaching, wherein the altering comprises forming an opening in the one panel of the storage bag in a portion sandwiched between the first and second portions of the valve assembly.

7. The method of claim 6, wherein the altering comprises inserting a needle through the two part valve and puncturing the one panel.

8. A user-installable valve assembly for use with a self-sealing collapsible storage bag having at least one sheet formed of flexible material, the valve assembly comprising:

a first portion comprising a housing having a first sealing surface, a snap protrusion, and containing a valve mechanism, wherein the snap protrusion comprises a hinge-like attachment to the first portion;

a second portion comprising a second sealing surface and an inner ring sized to pass over and interlock with the snap protrusion; and the snap protrusion being positioned relative to the first sealing surface to hold each of the first sealing surface and the second sealing surface against a portion of the sheet of the storage bag sandwiched therebetween and deformed about contours of the first portion with sufficient force to form a substantially airtight seal between the sheet of the storage bag and each of the first sealing surface and the second sealing surface while leaving the valve mechanism accessible to a user.

9. The valve assembly of claim 8 wherein the valve mechanism comprises a needle valve.

10. The valve assembly of claim 8 wherein the valve mechanism comprises a check valve.

11. The valve assembly of claim 8 wherein the first and second portions are formed from a food grade plastic.

12. The valve assembly of claim 8 wherein the valve assembly is user installable on a commercially available food storage bag.

13. The valve assembly of claim 8, the valve assembly further comprising a self-sealing mechanism on at least one side of the bag sheet.

14. The valve assembly of claim 8, wherein the first portion is adapted for use with a vacuum or pressurized fluid source comprising a nozzle coupled to the vacuum or pressurized fluid source, wherein the valve mechanism is configured to receive the nozzle to create a temporary opening in the substantially airtight seal to allow the atmosphere within the storage bag to be altered by selectively coupling the vacuum or pressurized fluid source to the bag interior using the nozzle, the nozzle extending at least partially through the valve mechanism to form the temporary opening.

15. The valve assembly of claim 14 wherein the vacuum or pressurized fluid source comprises a hand-operable pump.

16. The valve assembly of claim 8, wherein the snap protrusion comprises two or more protrusions extending outward from the sealing surface.

17. The valve assembly of claim 8, wherein the first portion comprises a cap, a keeper, and a closure mechanism configured to engage into the second portion with sufficient force to sandwich a portion of the sheet of the storage bag between a seat portion of the first sealing surface and the inner ring to form the substantially airtight seal.

18. The valve assembly of claim 8, wherein the first sealing surface and the second sealing surface are textured.

19. A valve assembly for use with a resealable storage bag having at least one wall formed form a thin sheet of flexible material, the valve assembly comprising:

a first portion comprising a cup and a valve positioned within an interior chamber of the cup, the cup further comprising an external sealing surface with a snap protrusion extending outward from the external surface, wherein the valve comprises a pressurized elastomer positioned in the cup for receiving a needle and for closing up to create a substantially airtight seal upon removal of the needle, and wherein the snap protrusion comprises a hinge-like attachment to the first portion; and a second portion comprising a snap ring with an internal sealing surface with an inner diameter greater than an outer diameter of the external sealing surface of the cup and less than outer dimensions of the cup at the snap protrusion, wherein the snap protrusion is positioned so that the flexible wall of the storage bag conforms to contours of the external sealing surface and mates with the external sealing surface and the internal sealing surface to form a substantially airtight seal between the flexible wall of the storage bag and each of the external sealing surface and the internal sealing surface when sandwiched between the first portion and the second portion and wherein the needle can pass through an opening in the snap ring while maintaining the substantially airtight seal.

* * * * *

UNITED STATES PATENT AND TRADEMARK OFFICE

CERTIFICATE OF CORRECTION

PATENT NO. : 7,614,203 B2
APPLICATION NO. : 10/905547
DATED : November 10, 2009
INVENTOR(S) : John P. Oltrogge It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 199 days.

Signed and Sealed this

Nineteenth Day of October, 2010

David J. Kappos

David J. Kappos
*Director of the United States Patent and Trademark Office*